US005489894A

United States Patent [19]

Murray

[11] Patent Number: 5,489,894

[45] Date of Patent: Feb. 6, 1996

[54] TELEVISION PAGING SYSTEM

[75] Inventor: Bradley A. Murray, West Palm Beach, Fla.

[73] Assignee: Motorola, Inc., Schaumburg, Ill.

[21] Appl. No.: 222,497

[22] Filed: Apr. 4, 1994

Related U.S. Application Data

[63] Continuation of Ser. No. 995,314, Dec. 22, 1992, abandoned, which is a continuation of Ser. No. 726,594, Jul. 8, 1991, abandoned.

[51] Int. Cl.[6] ..... G08B 5/22

[52] U.S. Cl. ..... 340/825.44; 455/38.4; 455/66; 348/563; 348/723

[58] Field of Search ..... 340/825.44; 455/38.1, 455/66, 38.4; 380/10, 11, 20; 348/563, 564, 723

[56] References Cited

U.S. PATENT DOCUMENTS 5,016,273 5/1991 Hoff ..... 340/825.44

FOREIGN PATENT DOCUMENTS 2302148 12/1990 Japan ..... 340/825.44

*Primary Examiner*—Brent A. Swarthout
*Assistant Examiner*—Andrew Hill
*Attorney, Agent, or Firm*—M. Mansour Ghomeshi

[57] ABSTRACT

A paging system (200)is provided having at least one television subscriber unit (222) with a television identification number and at least one paging subscriber unit (236) with a pager identification number. The paging system (200)includes a paging control station (240) for processing a page. This page includes the pager identification number that is intended for the at least one paging subscriber unit (236). The paging control station (240) includes a circuit (226) for determining when the at least one paging subscriber unit (236) is not in use. The paging system (200) also includes a television transmitter (216) which is coupled to the paging control station (240) for selectively transmitting the page to the television subscriber unit (222) in response to the circuit (226) for determining when the at least one paging subscriber unit (236) is not in use.

7 Claims, 5 Drawing Sheets

TELEVISION PAGING SYSTEM

This is a continuation of application Ser. No. 07/995,314, filed Dec. 22, 1992, now abandoned, which is a continuation of Ser. No. 07/726,594, Filed Jul. 8, 1991, and now abandoned.

Technical Field

This invention relates generally to paging systems and is more specifically related to paging systems using televisions as paging receivers.

BACKGROUND

It is well known that subscribers of paging systems must wear their pagers at all times when they are expecting others to contact them. In many situations the subscriber is not on the run such as when he is in his office or his home. In these situations he will either have to use his pager, or else advise people from whom he expects pages not to page him but rather to contact him on his telephone or use other means of contacting him. The later is for obvious reasons impractical. Therefore, a paging subscriber is required to carry his pager at all times when he expects a page. This allows the subscriber to travel freely within the range of the paging system and be able to receive messages as long as the pager is carried by the subscriber. However, if the subscriber goes home for the evening and still wishes to be contacted via the pager, the subscriber must continue to carry the pager. If the pager is removed from the body, it's receiving performance is degraded by the loss of the human body which functions as part of the antenna. The pager is also more likely to be misplaced once it is removed from the subscriber's body. In the case of doctors or other similar professionals, the pager must be constantly carried regardless of the subscriber's whereabouts. It is obvious that a need exists for a system that allows paging subscribers to receive a page without having to wear their pagers.

Additionally, anytime a paging company turns on their transmitters to send a page or a message, operating costs increase. This is due to power consumptions and other overhead. In order to reduce operating costs during low usage hours (evenings, etc . . . ), a paging company will turn on their transmitters to send messages when either a predetermined number of messages are ready to be sent or a predetermined time has elapsed since the last transmitted message. This reduces the operating costs but can cause delays to the subscriber. This delay, although tolerable in some instances, may not be acceptable to all subscribers. Furthermore, in the event of an emergency, the cost of delaying a page may be significant to the user which is a direct reflection on the performance of the paging company. It is therefore clear that a need exists for other methods of paging a subscriber without the subscriber having to constantly carry his pager.

SUMMARY OF THE PRESENT INVENTION

A paging system is provided having at least one television subscriber unit with a television identification number and at least one paging subscriber unit with a pager identification number. This paging system includes a paging control station for processing a page. This page includes the pager identification number that is intended for the at least one paging subscriber unit. The paging control station includes a circuit for determining when the at least one paging subscriber unit is not in use. The paging system also includes a television transmitter which is coupled to the paging control station for selectively transmitting the page to the television subscriber unit in response to the means for determining when the at least one paging subscriber unit is not in use.

In other aspects of the present invention, the paging system further includes a paging transmitter unit which is coupled to the paging control station for transmitting the page to the at least one paging unit in response to the means for determining when the at least one paging subscriber unit is not in use.

DETAILED DESCRIPTION OF THE PREFERRED EMBODIMENT

Figure 1:
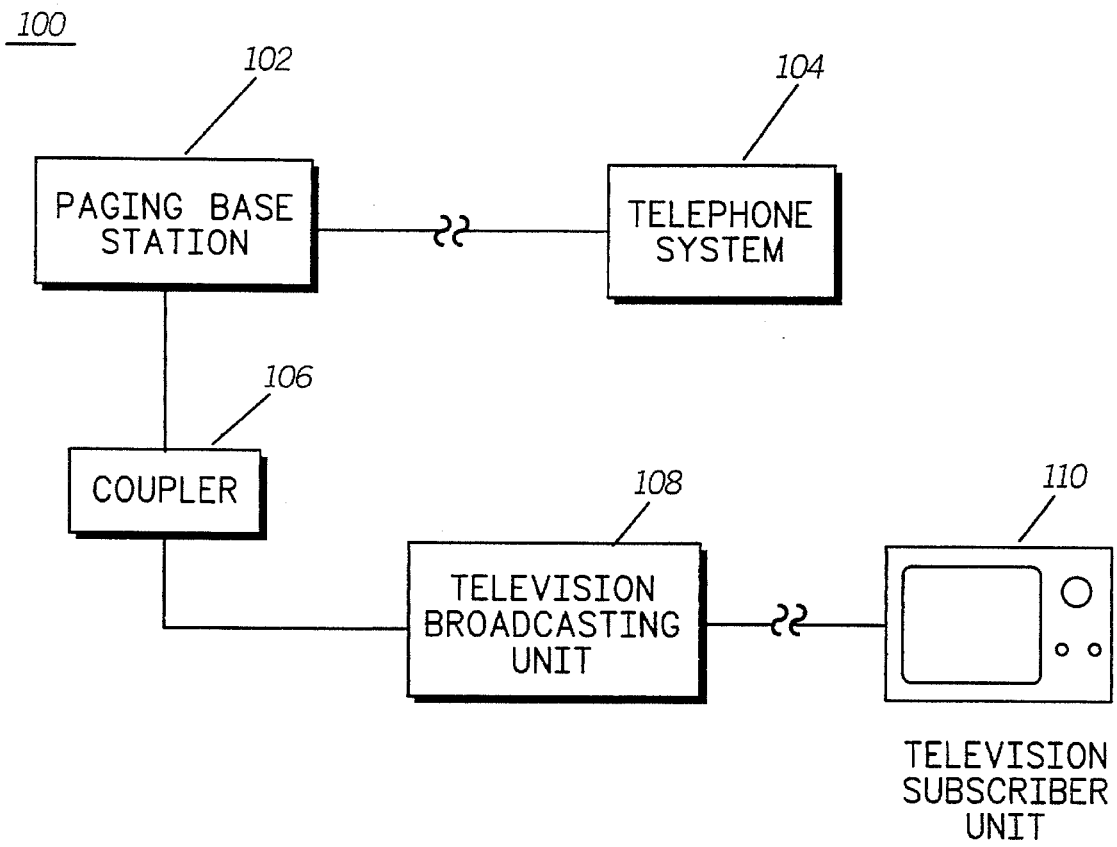
FIG. 1 shows a paging system in accordance with the present invention.

Referring to FIG. 1 a paging system 100 is shown in accordance with the present invention. The paging system 100 includes a paging base station 102 which is used as the paging control unit of the system 100. Also included in the system 100 is a telephone system 104 which is coupled to the paging base station 102. The telephone system 104 includes all the infrastructure that is needed to place a page to a user. This page may be initiated using a regular telephone or a dedicated data terminal. The paging information received by the paging base station 102 are coupled to a television broadcasting unit 108 through a coupler 106. Some of the tasks of the in the paging base station 102 include encoding of the paging information suitable for transmission. Normally, the paging base station 102 and the television broadcasting unit 108 are not located in one location. The coupler 106 is used to provide the link between these two elements. The coupler 106 may be in the form of dedicated wires for very large systems. Other forms of the coupler 106 employ telephone lines or microwaves links. Also included in the system 100 is a television subscriber unit 110 which includes necessary decoders to decode paging information signals. The television subscriber unit 110 receives pages transmitted by the television broadcasting unit 108. The communication between the television broadcasting unit 108 and the television subscriber unit 110 may be conducted via radio frequency signals and antennas on each element. Another method of providing communication between the two units is via the use of cable television (CATV)infrastructure. As is known, these are dedicated coaxial cables which are used to directly couple television broadcasting units to various television subscriber units at remote locations. These cables are used to carry regular television signals to be viewed on television subscriber units. With this invention, paging information can be carried by the same cables and presented on television subscriber units. People can be paged using existing infrastructure and the television sets at their home or office. The television subscriber unit 110 can be the very same television monitor that is used to view regular television signals with the addition of a decoder to decode the incoming paging information.

Figure 2:
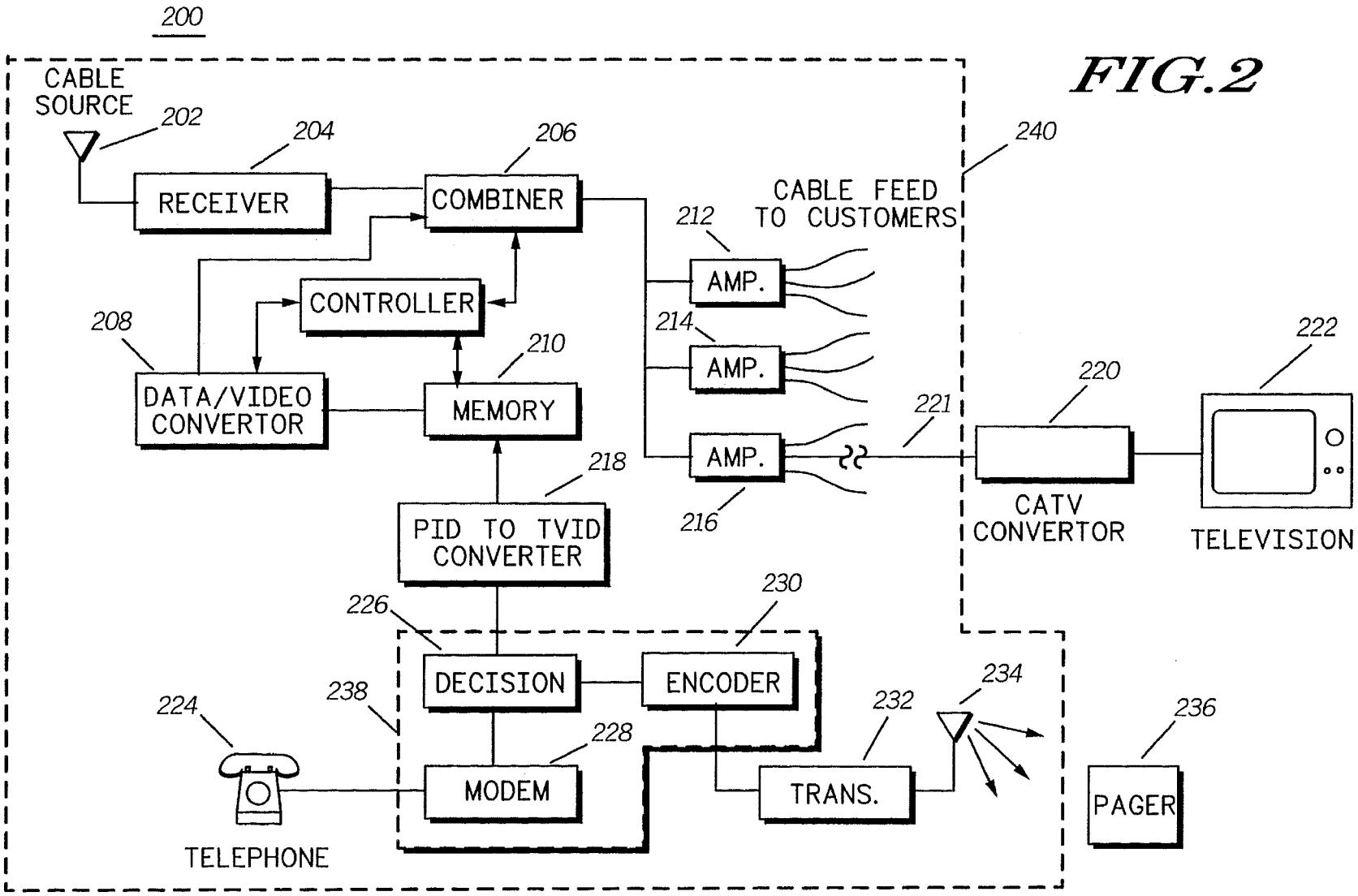
FIG. 2 shows television/pager paging system in accordance with the present invention.

Referring to FIG. 2, a more complete paging/television transmitting system 200 is shown in accordance with the present invention. The paging system 200 comprises three sections. A paging control station 240 which includes all the transmitting infrastructure that is needed to initiate, process, and transmit a page to a desired receiver. The second element is a paging subscriber unit 236, hereinafter referred to as pager, is used to receive a page transmitted by the paging control station 240. The third element is a television receiving unit comprising a television 222 and a CATV converter box 220. The converter box 220 has an associated television identification number (TVID). Similarly the paging subscriber unit has a pager identification number (PID). These ID numbers are selectively used to address a number of television subscriber units and pagers that are operating in the system 200. The converter box 220 includes circuitry to receive and combine paging information with television signals and subsequently couple the combined signals to the television 222. The elements of the converter 220 will be discussed in more detailed later. We turn our attention now to the paging control station 240 where the processing of a page and the decision as to whether to send a page to the pager 236 or the television 222 is made. A telephone 224 is used in the paging control station 240 to initiate a page to a user. Desired pages are entered into the telephone 224. The telephone 224 may include a full alphanumeric apparatus whereby complete text messages can be generated and processed for transmission to a user. Signals from the telephone 224 are coupled to a modem 228 where they are converted to digital signal. The information converted by the modem 228 are submitted to a decision making circuit 226. The circuit 226 includes timing circuitry and other circuits which are intended to accept paging information from the modem 228. The timing circuitry within the block 226 can be programmed to include the time of the day that the user of pager 236 will not be around his pager and that he desires for all of his incoming pages to be displayed on his television 222. This timing information can be stored in the decision logic 226. With this timing schedule, the decision logic 226 can develop a direction for the incoming pages. Also included in the decision logic 226 are circuits to accommodate incoming signals from the user of the pager 236 via the telephone 224 and the modem 228. The user can place a call to the paging control station 240 informing such system of his desires to receive pages on his television rather than on his pager, or both. This information is once again coupled to the decision logic 226 via the modem 228. The decision logic 226 places this information in its time table and processes any future incoming pagers accordingly. Two routes are available for the output signal depending on the decision made by the decision logic 226. A first route is taken when the incoming page is opted for transmission to the pager 236. In that event, the paging information is coupled to an encoder 230 where it is encoded to the form proper for pager 236. The encoded paging information signal of the encoder 230 is then coupled to a transmitter 232 which includes an antenna 234. The transmitter 232 further processes the paging information and transmits it via the antenna 234. Transmitted signals intended for the pager 236 are received by the pager 236. The operation of the encoder 230, transmitter 232 and the method of transmitting a page are similar to those used in existing paging systems and are well known in the art.

When the decision at the decision logic 226 is to send the incoming page to the television 222, the paging information is coupled to a converter 218. The converter 218 converts the PID of the desired outgoing page to the associated TVID. Because of the existing paging infrastructure it is more probable that the PID's are different from the TVID's. However, it is feasible for both such numbers to be same thereby eliminating the need for the converter 218. The output of the converter 218 is coupled to a memory block 210 where pages may be stored for future utilization. A controller 205, controlling the operation of the paging control station 240, directs a data/video converter 208 to fetch the latest stored information from the memory 210 for transmission. The converter 208 converts the data retrieved from the memory 210 to video signals and couples them to a receiver 204. The receiver 204 also receives television signals via the antenna 202. The television signals along with paging information are combined via a signal combiner 206 which is under the control of the controller 205. The combiner 206 uses an available radio frequency channel in the CATV bands to communicate the paging information to the television subscriber unit 222 on the existing cable TV cables. The output of the combiner 206 is coupled to amplifiers 212, 214, and 216. The number of amplifiers depend on the number of users that subscribe to the paging or cable TV system. The output of these amplifiers 212, 214, and 216 are coupled to television subscriber units via cables and converters. For this embodiment, the amplifier 216 is shown to be coupled to a cable TV converter 220 via the coaxial cable 221. The encoded page amplified by the amplifier 216 having the correct address is received and processed by the converter 220. The paging information is then presented to the user on the television 222 as subtitles. The amplifiers 212, 214, and 216 provide the television transmitter means for the system 200.

Current cable systems use remotely addressable cable TV converters so that a cable user does not have to return their converter boxes to the cable company if channel updates are needed. The cable company simply gives each converter an address (TVID) and can manipulate the functions of each converter via the cable lines. The converter address can then be used to alert the cable TV converter 220 of an incoming page. One of the elements of the combiner 206 is a caption machine that converts data paging messages into video signals. Caption machines are well known in the art and are existing devices that are used to put captions at the bottom of a TV screen. Note that the information processed by the combiner 206 is submitted to all the amplifiers and therefore placed on all the cables within a working system. Converters belonging to television units for whom a page is not intended would not allow the page to pass through to their respective televisions. The TVID embedded in the paging information directs the converter 220 that this is a page intended for the television 222 and that is the method by which the user is selected. This scheme prevents other television units within a working system from receiving undesired pages.

In summary, the paging system 200 is shown to include an infrastructure for selectively paging a user via his pager 236 or his television set 222. The infrastructure includes the telephone 224 for initiating a page, a decision making circuit 226 for determining when the page shall be transmitted to the pager 236, the television unit 222 of the subscriber, or both. Upon determination that a received page is to be displayed on the television 222, any conversion in the identification of the page will be made at the PID to TVID converter 218. The paging information is then combined with regular television signals by using an available radio frequency channel in the CATV band. Amplifiers 212, 214, and 216 are used to amplify the television signals before such signals are placed on cables. The cable converter 220 receives a desired page along with regular television signals and presents both such signals to the television subscriber unit 222. The paging information will appear as captions at the bottom of the television screen.

Figure 3:
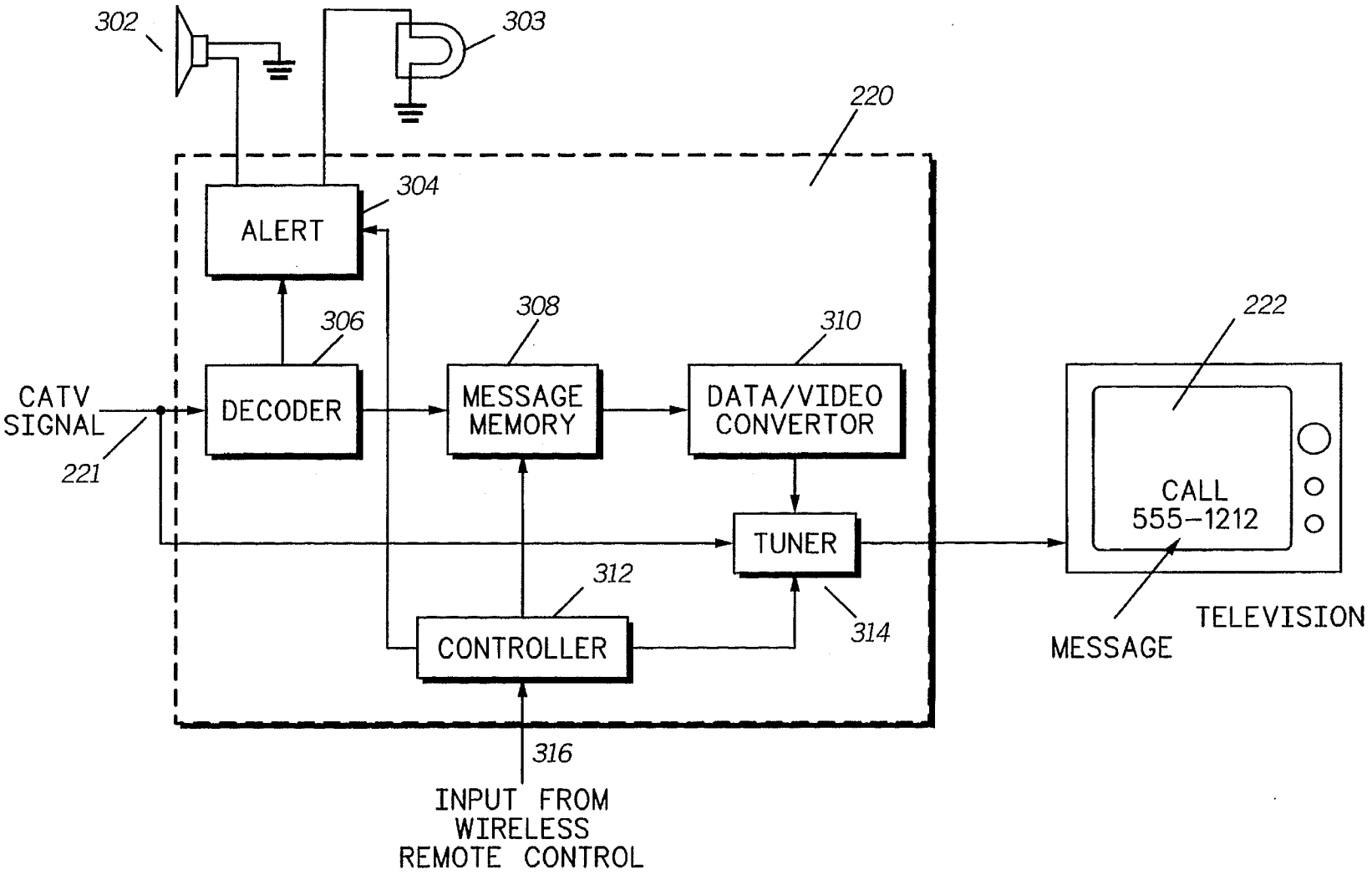
FIG. 3 shows a block diagram of the elements of a television converter in accordance with the present invention.

Referring now to FIG. 3, a block diagram of the cable TV converter box 220 is shown in accordance with the principles of the present invention. Cable TV. signals on the cable 221 are coupled to a decoder 306 and a tuner 314. The tuner 314 presents the incoming CATV signals to the television 222. The paging information that are on the cable 221 are decoded by the decoder 306 and a determination is made as to whether these paging signals are intended for the television 222. In the event that they are, a signal is sent to an alert block 304 where an alert signal is generated to inform the user of an incoming page. This alert signal is coupled to a speaker 302 for audio indication or an incandescent light 303 for visual indicator such as. This alert is similar to the beep that is presented to the user on the pager 236. The decoded information from the decoder 306 is coupled to a memory block 308. The paging information is stored in this block 308 for future use, in the event that it is necessary to recall a page. A controller 312 controls the operation of the converter box 220. Inputs 316 from a wireless remote control unit (not shown) are coupled to the controller 312. These input command the converter box 220 to perform a desired function. One such function would be to display a particular page one more time, change channel, or scan channels. The controller 312 is coupled to the tuner 314 for any regular television operations that can be controlled via the converter box 220. The controller 312 is also coupled to the memory block 308. Information from the memory block 308 are directed to a data/video converter 31 0 under the control of the controller 312. The converter 310 converts digital paging information to video information where they are coupled to the tuner 314 for presentation on the television 222. The tuner 314 combines the paging information along with the regular television information and presents the combined signal to the television 222. Included within the tuner 314 may be a caption machine that provides the means to put captions at the bottom or anywhere else on the screen of the television 222. It is obvious that the caption machine in the tuner 314 is not needed if the paging information is captioned as is received on the cable 221. The controller 312 is also coupled to the alert block 304. Once the page has been displayed on the television 222, the user using his wireless remote control or other means of communicating to the converter box 220 can inform the controller 312 to switch the alert signal off. The controller 312 then signals the alert box 304 to discontinue the alert signal sent to the speaker 302 or the visual indicator 303. Using the converter box 220, paging information along with regular television information can be coupled to the television 222 without any additional circuitries.

Figure 4:
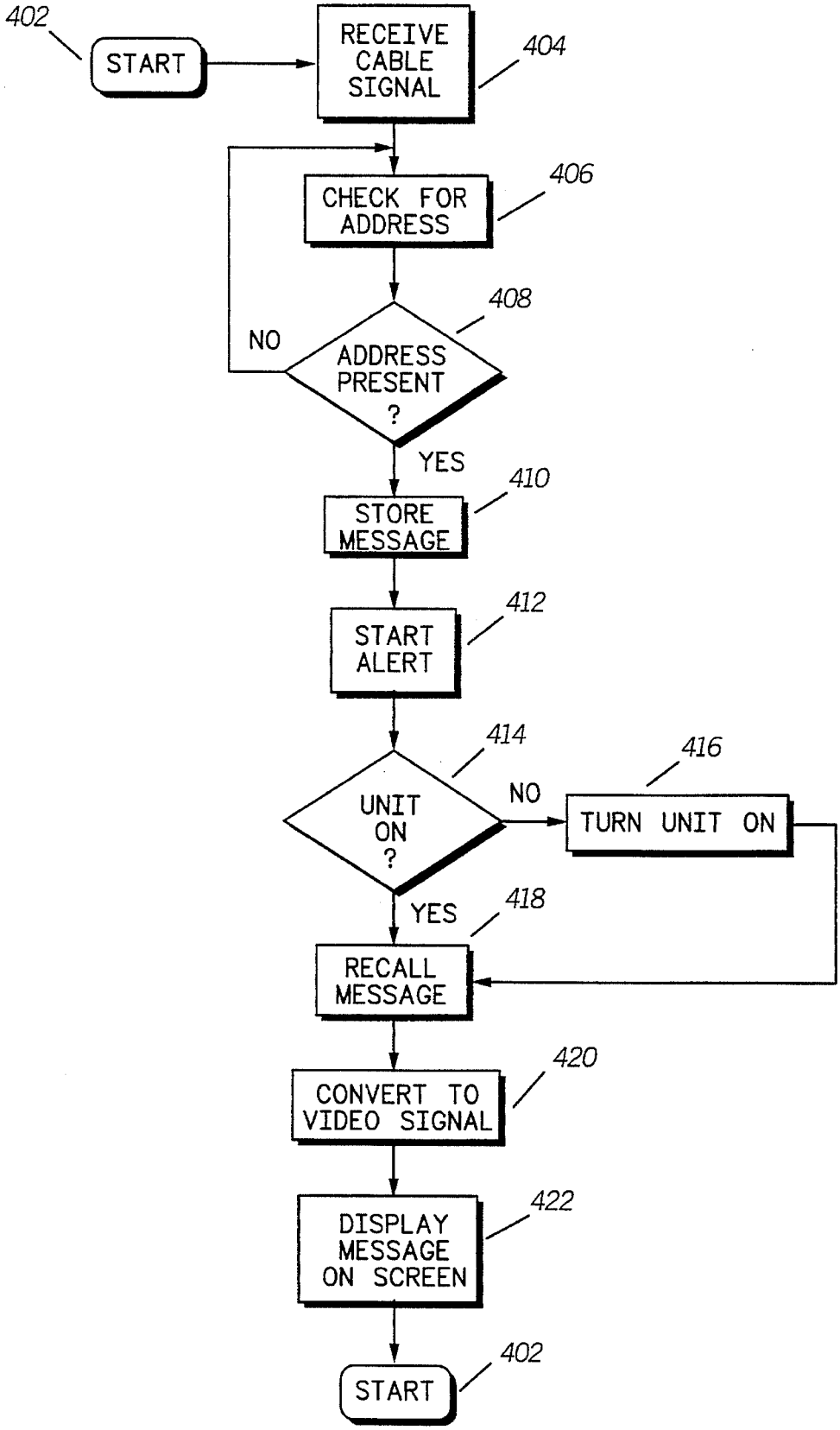
FIG. 4 shows a flow chart of the operation of the paging system of FIG. 2.

Referring to FIG. 4, a flow chart of the operation of the converter 220 is shown in accordance with the present invention. From a start block 402, the converter box 220 receives a signal via block 404. The signal is checked for proper address via a check for address block 406. The output of this block 406 is coupled to a decision block 408, where the presence of an address is determined. The no output of the decision block 408 is looped back to the input of the check for address block 406. This loop continues until an address is present which results in the output of the decision block 408 to become yes. This YES output is coupled to the stored message block 410 followed by a start alert block 412. Once an alert signal has been generated, the operation is coupled to a decision block 414 where it is determined as to whether the television 222 is ON or OFF. The NO output of the decision 414 indicating that the television 222 is in the OFF position is coupled to a turn unit ON block 416. With the block 416 the television 222 is turned ON and the operation continues by recalling the stored message via a block 416. This block 416 is also coupled to the YES output of the decision block 414. With block 418, the message stored in the memory block 308 is recalled and applied for conversion to video signal via a block 420. The output of convert to video signal block 420 is coupled to display message on screen block 422. In this block, the information is submitted to the tuner 314 where they are processed to be displayed on the television 222. The output of the display message on the screen block 422 returns the operation to the start block 402.

Figure 5:
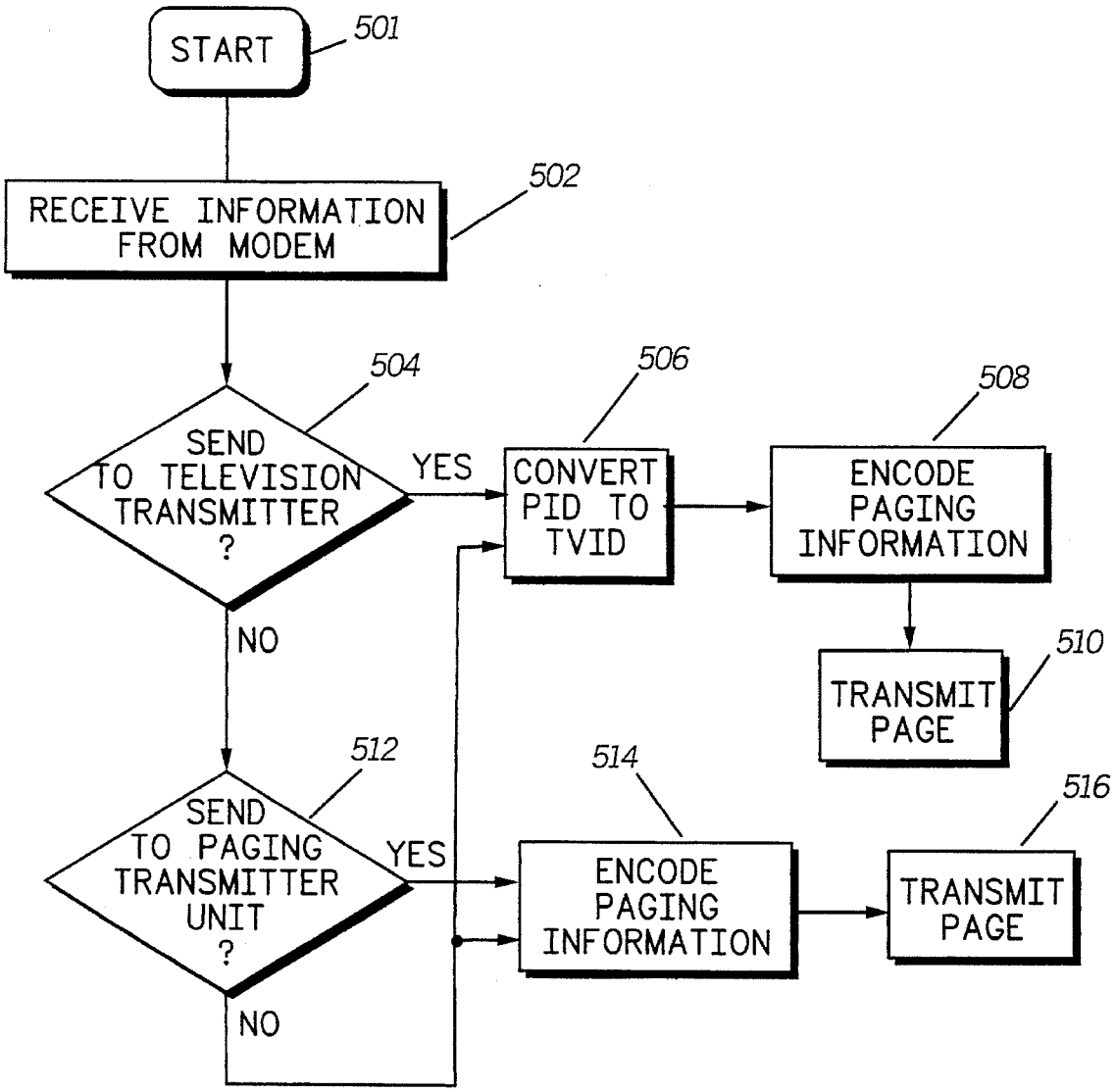
FIG. 5 is a flow chart of the decision making process that the paging system of FIG. 2 follows to determine how to deliver a desired page.

Referring to FIG. 5, a block diagram of the operation of the decision block 226 of the paging system 200 is described in accordance with the present invention. From a start block 501, the operation is coupled to a receive information from modem block 502. At block 502, the information received by the modem 228 is received by the decision circuitry 226. The output of block 502 is coupled to a decision block where a decision is made as to whether an incoming page from the modem 228 should be sent out to the pager 236 or the television 222. The decision block send to television transmitter 504 determines whether the page is desired for the television 222. The YES output of the block 504 is coupled to a convert PID to TVID block 506. At this block, the associated pager identification is converter to the corresponding TV identification number. The output of block 506 is coupled to an encode paging information block 508 where the paging information is encoded to the proper code for transmission via block transmit page 510 coupled to the output of block 508. The NO output of the decision block 504 is coupled to another decision block 512 where a decision is made as to whether to send the paging information to the paging transmitter unit 232. The YES output of the decision block 512 is coupled to an encode paging information 514 where the paging information is appropriately encoded into proper form for transmission via the transmitter 232, as indicated by transmit page block 516. The NO output of the decision block 512 indicates that the desired page is to be sent both to the pager 236 and the television 222. Consequently, this no output is coupled to both blocks 506 and 514 for proper processing of the paging information.

To summarize, a paging system is described using existing cable television infrastructure and existing paging system infrastructure to couple the page intended for a user to his pager or his television unit depending on his requirements. These requirements could be time related or user initiated depending on circumstances. The decision making circuitry is used to determine when an initiated page should be transmitted to the pager or the television. The use of existing cable TV infrastructure provides a significant facility without the additional cost of implementing such facilities. This eliminates the needs for direct communication between the television and the paging system. The coupling of the paging information to the television is conducted via a converter that is also used to couple cable TV information signals to the television. This system would allow a paging company to reduce operating cost by sending messages over existing television cable lines without the need for high power transmitters. This system also allows subscribers to remove their pagers once they reach home or their office and use their cable TV converters/TV set for a message receiving device. This system could be used in addition to a normal paging service as an information service which displays stock prices or sports scores. Another significant benefit of this invention is the reduction in the throughput of paging systems. This reduction in throughput is realized by not having to use air time to page users while at home. The system is available more readily to page others that carry their pagers and are not near or around their television sets. With this, many number of pager units would be remove from the system at the command of the users relieving the paging system of the pressure to transmit to those pagers.

What is claimed is:

1. A paging system having at least one television subscriber unit with a television identification number (TVID) and at least one paging subscriber unit with a pager identification number (PID), the paging system comprising:

a paging control station for processing a page having a PID and intended for the at least one paging subscriber unit, the paging control station having a decision making means for locally determining if the page is desired to reach the television subscriber unit instead of the at least one paging subscriber unit; and a television transmitter means coupled to the paging control station for selectively transmitting the page to the television subscriber unit and preventing transmission of the page to the at least one paging subscriber unit in response to the means for determining.

2. The paging system of claim 1, further including a paging transmitter unit coupled to the paging control unit for transmitting the page to the at least one paging subscriber unit in response to the means for determining.

3. The paging system of claim 1, wherein the television subscriber unit includes means for generating an alert signal in response to the page.

4. The paging system of claim 1, further including converter means for converting the PID of the page to a corresponding TVID.

5. The paging system of claim 1, wherein the television transmitter comprises a cable television (CATV) broadcasting unit.

6. The paging system of claim 1, wherein TVID and the PID are the same number.

7. A paging system having at least one television subscriber unit with a television identification number (TVID) and at least one paging subscriber unit with a pager identification number (PID), the paging system comprising:

a paging interface unit for receiving information to be paged, the interface unit having a decision making means for determining if a page is desired to reach the television subscriber unit instead of the at least one paging subscriber unit;

means for generating a paging signal;

means for receiving a television signal;

a combiner for combining the television signal with the paging signal;

a controller coupled to the paging interface unit for coupling the paging signal to the combiner when the page is desired to reach the television subscriber unit;

a television transmitter means coupled to the combiner for subsequently transmitting the page along with the television signal to the television subscriber unit; and whereby the television subscriber unit receives the page and the television signal and immediately displays the same.

* * * * *